US010736352B2

(12) United States Patent
Eckhoff

(10) Patent No.: US 10,736,352 B2
(45) Date of Patent: Aug. 11, 2020

(54) SMOKING-PIPE HAVING MULTIPLE SELECTABLE CHAMBERS AND METHOD

(71) Applicant: Ryan Eckhoff, New London, MN (US)

(72) Inventor: Ryan Eckhoff, New London, MN (US)

( * ) Notice: Subject to any disclaimer, the term of this patent is extended or adjusted under 35 U.S.C. 154(b) by 261 days.

(21) Appl. No.: 15/896,057

(22) Filed: Feb. 13, 2018

(65) Prior Publication Data

US 2018/0228211 A1 Aug. 16, 2018

Related U.S. Application Data

(60) Provisional application No. 62/459,603, filed on Feb. 15, 2017.

(51) Int. Cl.
*A24F 5/10* (2006.01)
*A24F 1/00* (2006.01)

(52) U.S. Cl.
CPC ..... *A24F 5/10* (2013.01); *A24F 1/00* (2013.01); *A24F 2700/01* (2013.01); *A24F 2700/08* (2013.01)

(58) Field of Classification Search
None
See application file for complete search history.

(56) References Cited

U.S. PATENT DOCUMENTS 4,307,734 A * 12/1981 Blankenship ..... A24F 23/00 128/203.15
6,418,936 B1 7/2002 Lee
2009/0258117 A1* 10/2009 Lee ..... A24F 1/32 426/104
2012/0204888 A1* 8/2012 Descamp ..... A24F 1/06 131/180

* cited by examiner

*Primary Examiner* — Michael H. Wilson
*Assistant Examiner* — Katherine A Will
(74) *Attorney, Agent, or Firm* — Acumen Intellectual Property; Michael C. Balaguy

(57) ABSTRACT

A smoking-pipe includes a pipe body, a cylinder, and a cylinder cover. The cylinder includes a plurality of smoking-chambers which may hold a reserve of combustible material for smoking. The cylinder may be positioned selectively to allow one smoking chamber at a time to be combusted, effectively providing a pipe which may be smoked through multiple sessions without requiring continual repacking.

16 Claims, 5 Drawing Sheets

SMOKING-PIPE HAVING MULTIPLE SELECTABLE CHAMBERS AND METHOD

CROSS-REFERENCE TO RELATED APPLICATION(S)

The present application is related to and claims priority to U.S. Provisional Patent Application No. 62/459,603 filed Feb. 15, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of smoking-equipment of existing art and more specifically relates to smoking-pipes.

RELATED ART

Smoking is a practice by which a substance is combusted and the resulting smoke breathed in to be tasted, or alternatively, inhaled and absorbed into the bloodstream. Smoking is primarily practiced as a route of administration for recreational drug use because the combustion of the dried plant leaves vaporizes and delivers active substances into the lungs where they are rapidly absorbed into the bloodstream to reach bodily tissue.

Many smokers enjoy smoking fresh tobacco or other substances out of a pipe, as opposed to pre-rolled cigarettes. Unfortunately, it can be a hassle not only for smokers to carry around a pouch of tobacco and a pipe but also to stop and pack the pipe whenever the mood strikes. Smokers may also make a mess if the pouch spills or drops. A suitable solution is desired.

U.S. Pat. No. 6,418,936 to Jake Lee relates to a tobacco pipe. The described tobacco pipe includes a pipe having a hollow stem threaded to a manifold on top of which a turret is rotatably mounted. The turret is of greater weight than the manifold, so that any one of a plurality of turret magazines remains stationary over a chamber in the manifold in their relative rotation, so that smoking tobacco in a magazine aligned with such chamber takes place through the hollow stem.

SUMMARY OF THE INVENTION

In view of the foregoing disadvantages inherent in the known smoking-pipe art, the present disclosure provides a novel smoking-pipe having multiple selectable chambers and method. The general purpose of the present disclosure, which will be described subsequently in greater detail, is to provide an efficient and effective smoking-pipe having multiple selectable chambers.

A smoking-pipe is disclosed herein. The smoking-pipe includes a pipe body, a cylinder, and a cylinder cover. The pipe body may be constructed using a cylindrical base, a shank affixed to the cylindrical base, and an axis shank extending upwardly from the center of the cylindrical base.

The cylindrical base may have a first end, a second end, a circular outer cylinder surface, a first base-aperture in the first end, and a second base-aperture in the circular outer cylinder surface. The pipe base may include an internal cavity for the passage of smoke connecting the first base-aperture to the second base-aperture. The shank may include an attachment end connected directly to the second base-aperture and may also include an internal cavity for the passage of smoke connecting the second base-aperture to a mouthpiece through which smoke may be drawn by the user. The axis shank may be connected to the first end, being concentric to the cylindrical base and extending upwardly from the cylindrical base.

The cylinder may also be cylindrically shaped and may also have an outer cylinder surface. The cylinder may include a central axis shaft-aperture concentric to the circular outer cylinder surface that mates to the axis shank on the pipe body, such that the cylinder may revolve about the axis shank while being restricted to the rotational axis of the axis shank and the central axis shaft-aperture. A plurality of smoking chambers comprising apertures may be radially arrayed about the central axis shaft-aperture, being parallel to each other and to the central axis shaft-aperture. Each of the plurality of smoking chambers may be positioned relative to the circular outer cylinder surface such that they may align with the first base-aperture when the cylinder is rotated appropriately. Each of the smoking chambers are configured to hold a reserve of combustible material for smoking and may be selectively and rotationally positioned about the axis shank.

The cylinder-cover may comprise a circular or cylindrical plate configured to cover the plurality of smoking chambers of the cylinder having a cover shank concentric to the cylinder-cover which attaches directly to the axis shank of the pipe body. The cylindrical plate also acts as a retainer to hold the cylinder to the pipe body, while yet permitting the cylinder to revolve about the axis shank. The cylinder-cover may include a cover-aperture perforating the cylindrical plate in such a position that it may align with the first base-aperture when the cylinder-cover is rotated appropriately.

According to another embodiment, a method of smoking multiple reserves of combustible material with a smoking-pipe is also disclosed herein. The smoking-pipe includes firstly, providing the described smoking-pipe; secondly, placing the combustible material to be smoked in at least one of the plurality of smoking-chambers; thirdly, aligning one of the smoking-chambers with the first-base aperture and the cover-aperture; fourthly, combusting the combustible material within the chosen smoking-chamber; fifthly, drawing a smoke produced by the combustible material though the internal shank-cavity into a mouth of a user; sixthly, tasting and alternatively inhaling the smoke; seventhly, continuing to smoke until the combustible material within the chosen smoking-chamber is consumed; eighthly, re-aligning another one of the plurality of smoking chambers with the first-base aperture and the cover-aperture, such that a fresh reserve of the combustible material is available to be smoked; ninthly, repeating the process for successive smoking-chambers until the combustible material within all of the plurality of smoking-chambers is spent; and tenthly and optionally, covering a carb-extension attached to the pipe body while smoking to regulate airflow into the smoking-pipe base.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a smoking-pipe having multiple selectable chambers and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a smoking-pipe and more particularly to a smoking-pipe having multiple selectable chambers and method, as used to improve the smoking experience.

Generally, the disclosed smoking-pipe provides a convenient way to pack, carry, and smoke tobacco within a smoking pipe. In a preferred embodiment, the pipe integrates up to five tobacco bowls or chambers for enabling successive smoking without necessitating continual packing of the bowl. This methodology eliminates the need to carry around a pouch of tobacco all day, saving users a considerable amount of time when enjoying a smoking session. The pipe also covers and stores tobacco when not in use, having a cover which contains and conceals all of the tobacco bowls. In use, the pipe may be rotated over the pipe to align a chosen, packed tobacco bowl with the channel in the pipe from which the user may smoke. Each bowl may be selectively aligned with the pipe stem for smoking one at a time. Preferably, the pipe may be made from metal or another suitable material. The exact specifications may vary upon manufacturing.

Referring now more specifically to the drawings by numerals of reference, there is shown in FIGS. 1-4, various views of a smoking-pipe 100.

Figure 1:
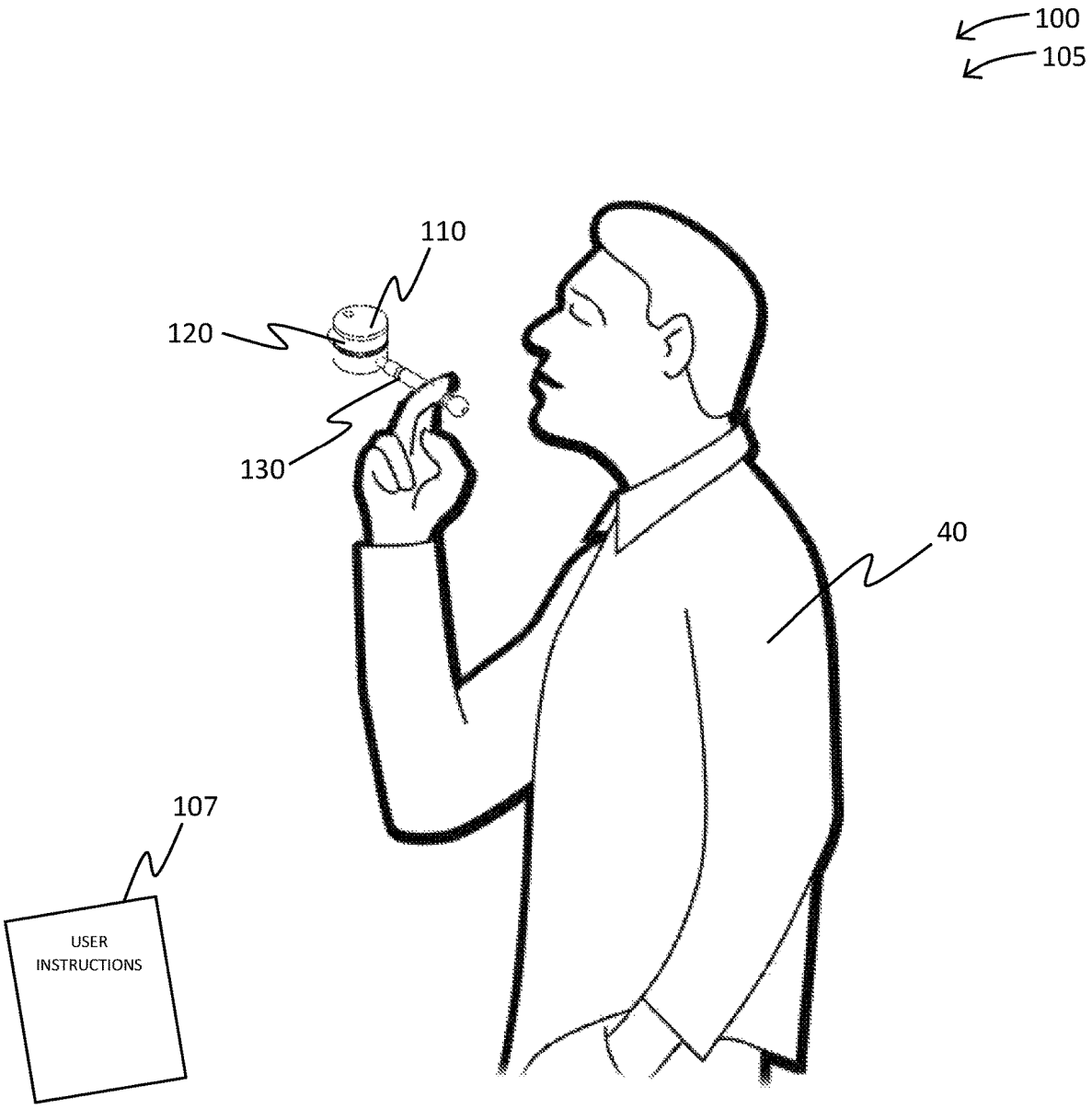
FIG. 1 is a perspective view of the smoking-pipe and a user during an 'in-use' condition, according to an embodiment of the disclosure.

FIG. 1 shows a smoking-pipe 100 during an 'in-use' condition, according to an embodiment of the present disclosure. Here, smoking-pipe 100 may be beneficial for use by a user 40 to smoke multiple reserves of combustible material within a smoking-pipe 100. As illustrated, smoking-pipe 100 may include smoking-pipe body 110, cylinder 120, and cylinder-cover 130. Smoking-pipe body 110, cylinder 120, and cylinder-cover 130 may be constructed of steel, aluminum, or brass. Cylinder 120 and cylinder-cover 130 may each be lathe-turned during manufacture. Upon reading this specification, it should be appreciated that, under appropriate circumstances, considering such issues as user preferences, design preference, structural requirements, marketing preferences, cost, available materials, technological advances, etc., other structural arrangements such as, for example, additional cover configurations, different numbers of smoking-chamber, alternative shank designs, etc., may be sufficient. Also, those with ordinary skill in the art will now appreciate that upon reading this specification and by their understanding the art of smoking as described herein, methods of smoking will be understood by those knowledgeable in such art.

According to one embodiment, the smoking-pipe 100 may be arranged as a kit 105. In particular, the smoking-pipe 100 may further include a set of instructions 107. The instructions 107 may detail functional relationships in relation to the structure of the smoking-pipe 100 such that the smoking-pipe 100 can be used, maintained, or the like, in a preferred manner.

Figure 2:
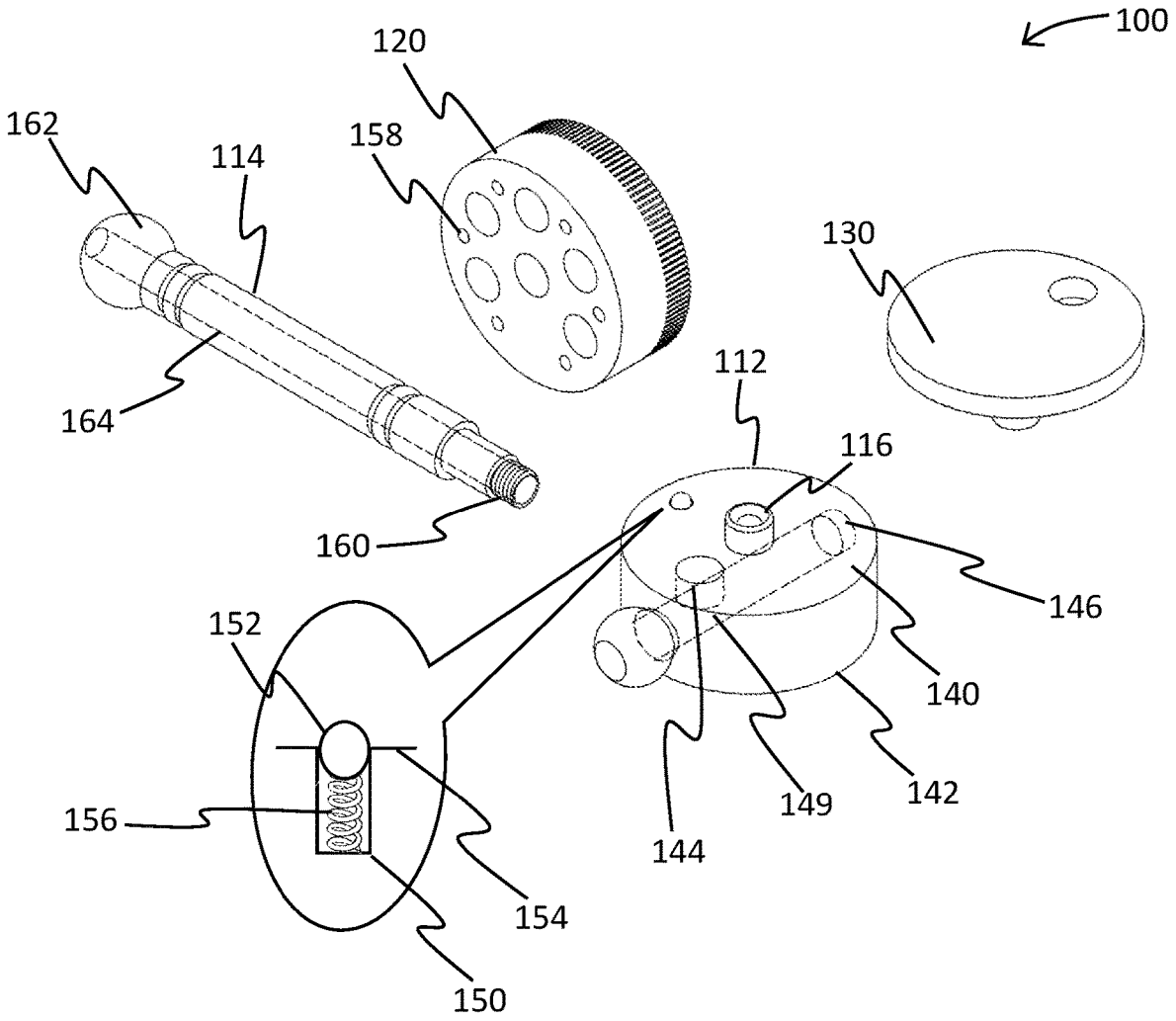
FIG. 2 is a perspective view of the smoking-pipe of FIG. 1 in a disassembled configuration, according to an embodiment of the present disclosure.

FIG. 2 shows smoking-pipe 100 of FIG. 1, according to an embodiment of the present disclosure. As above, smoking-pipe 100 may include smoking-pipe body 110, cylinder 120, and cylinder-cover 130. Smoking-pipe body 110 may include cylindrical base 112 having first-cylinder end 140, second-cylinder end 142, first-base aperture 144 disposed within first-cylinder end 140, second-base aperture 146 disposed within radial outer base-surface 148 (FIG. 3), and internal base-cavity 149 connecting first-base aperture 144 and second-base aperture 146. Shank 114 has attachment-end 160 coupled to second-base aperture 146 of cylindrical base 112, mouthpiece 162 distal to attachment-end 160, and internal shank-cavity 164 comprising a passageway connecting attachment-end 160 to mouthpiece 162, and cylindrical axis-shaft 116 affixed to and concentric to first-cylinder end 140. Second-base aperture 146 of cylindrical base 112 may include internal threading. Attachment-end 160 of shank 114 may include external threading dimensioned to removably couple with second-base aperture 146 of cylindrical base 112.

Smoking-pipe body 110 further includes detent-aperture 150 disposed within first-cylinder end 140, detent-sphere 152 retained within detent-aperture 150, detent-retainer 154 circumscribing detent-aperture 150, such that detent-retainer 154 engages and retains detent-sphere 152 within detent-aperture 150, such that detent-sphere 152 is able to partially protrude from but not leave detent-aperture 150, and detent-spring 156 disposed within detent-aperture 150 pressing detent-sphere 152 against detent-retainer 154. Cylinder 120 further includes plurality of detent-recesses 158 configured to engage detent-sphere 152 when detent-spring 156 presses detent-sphere 152 against detent-retainer 154, detent-spring 156 being configured to simultaneously press detent-sphere 152 against the cylinder. Plurality of detent-recesses 158 correspond to plurality of smoking-chambers 126 (FIG. 4), such that a first of plurality of detent-recesses 158 engages detent-sphere 152 when a first of plurality of smoking-chambers 126 (FIG. 4) aligns with first-base aperture 144, and such that a second of plurality of detent-recesses 158 engages detent-sphere 152 when a second of plurality of smoking-chambers 126 aligns with first-base aperture 144, and so forth.

Figure 3:
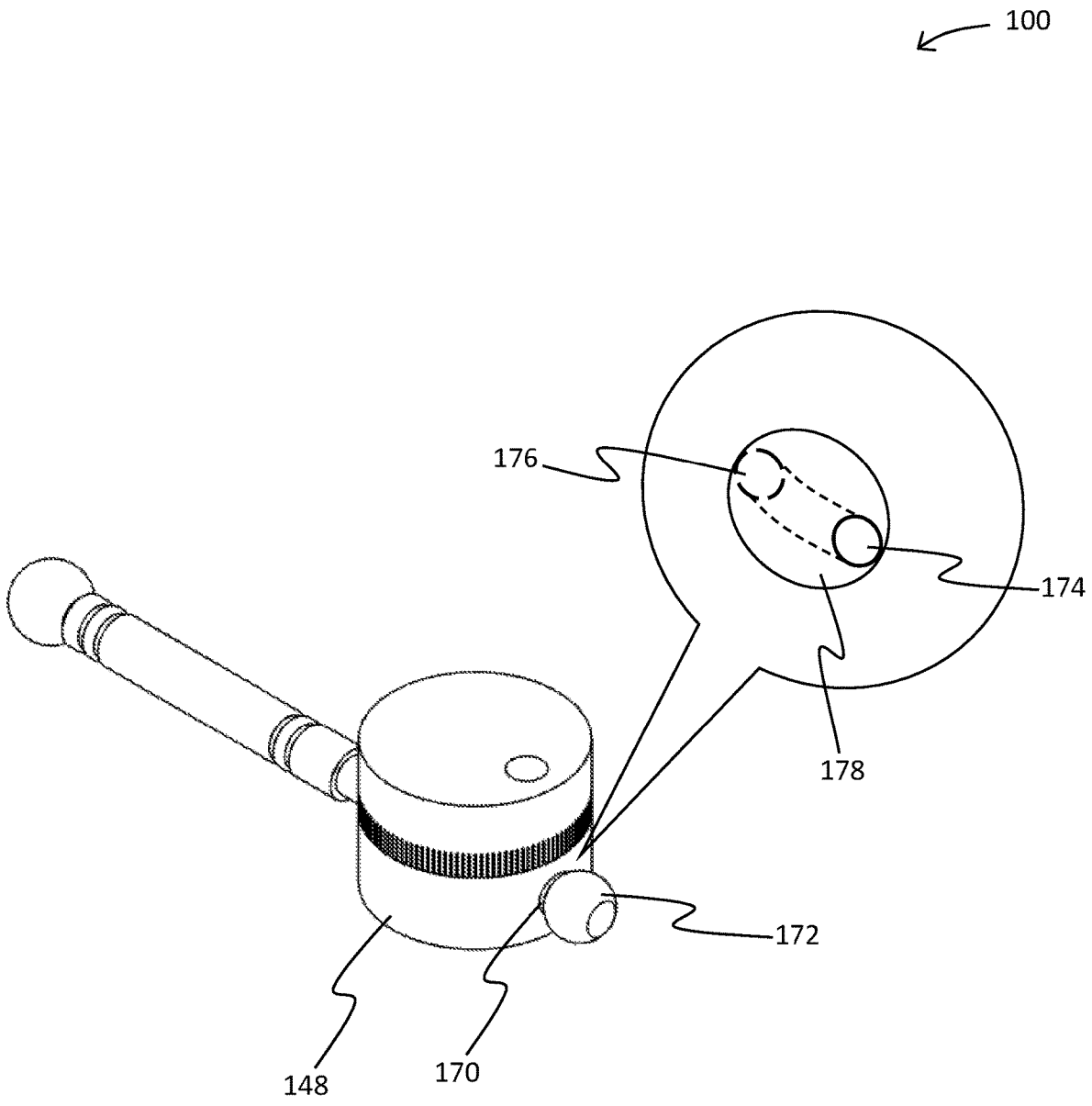
FIG. 3 is a perspective view of the smoking-pipe of FIG. 1, according to an embodiment of the present disclosure.

Referring now to FIG. 3, a perspective view of smoking-pipe 100 of FIG. 1, according to an embodiment of the present disclosure. Smoking-pipe body 110 may also include radial outer base-surface 148. Smoking-pipe body 110 may further include carb-aperture 170 disposed on radial outer base-surface 148, carb-aperture 170 being in fluid communication with internal base-cavity 149 (FIG. 2). Smoking-pipe 100 may also further include carb-extension 172 comprising a spherical member coupled to carb-aperture 170. Carb-extension 172 may have first-extension aperture 174 in abutment against carb-aperture 170, second-extension aperture 176 distal to first-extension aperture 174, internal carb-cavity 178 comprising a passageway connecting first-extension aperture 174 and second-extension aperture 176 in fluid communication with carb-aperture 170, such that carb-extension 172 functions as an air inlet for internal base-cavity 149 (FIG. 2). Carb-aperture 170 may include internal threading. Carb-extension 172 may further include external threading dimensioned to removably couple with carb-aperture 170.

Figure 4:
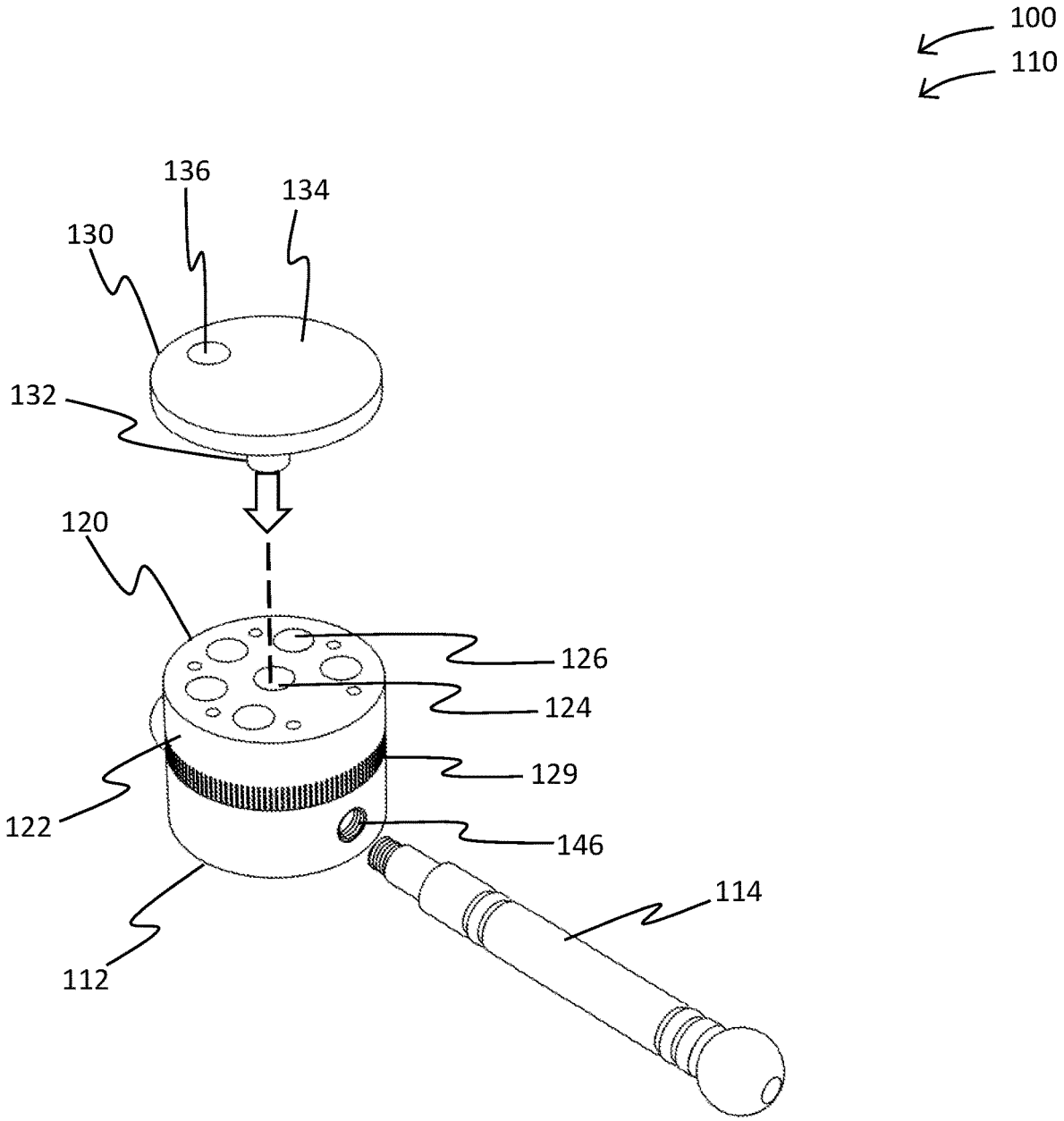
FIG. 4 is a perspective view of the smoking-pipe of FIG. 1 demonstrating the attachment of the cylinder-cover to the pipe body, according to an embodiment of the present disclosure.

FIG. 4 is a perspective view of smoking-pipe 100 of FIG. 1, according to an embodiment of the present disclosure. Cylinder 120 may be configured to revolve about cylindrical axis-shaft 116 (FIG. 2), and may include radial outer cylinder-surface 122, axis shaft-aperture 124 concentric to cylinder 120 dimensioned such that the axis-shaft aperture may accept and engage cylindrical axis-shaft 116 (FIG. 2), and plurality of smoking-chambers 126 arranged radially about axis shaft-aperture 124 configured to align selectively with first-base aperture 144 (FIG. 2); and cylinder-cover 130 coupled to smoking-pipe body 110 having cover-shank 132 releasably coupled to cylindrical axis-shaft 116, shield 134 permanently coupled to cover-shank 132, such that shield 134 covers and retains cylinder 120 to cylindrical base 112 when cover-shank 132 is coupled to cylindrical axis-shaft 116 (FIG. 2). Cover-aperture 136 perforating shield 134 position concentrically to first-base aperture 144 (FIG. 2) when cover-shank 132 is coupled to cylindrical axis-shaft 116 (FIG. 2). Plurality of smoking-chambers 126 may include five adjacent smoking-chambers. Radial outer cylinder-surface 122 is knurled, radial outer cylinder-surface 122 having plurality of ridges 129 configured to improve grip by a user engaging radial outer cylinder-surface 122. Shank 114 may be removably attachable to second-base aperture 146 of cylindrical base 112.

Figure 5:
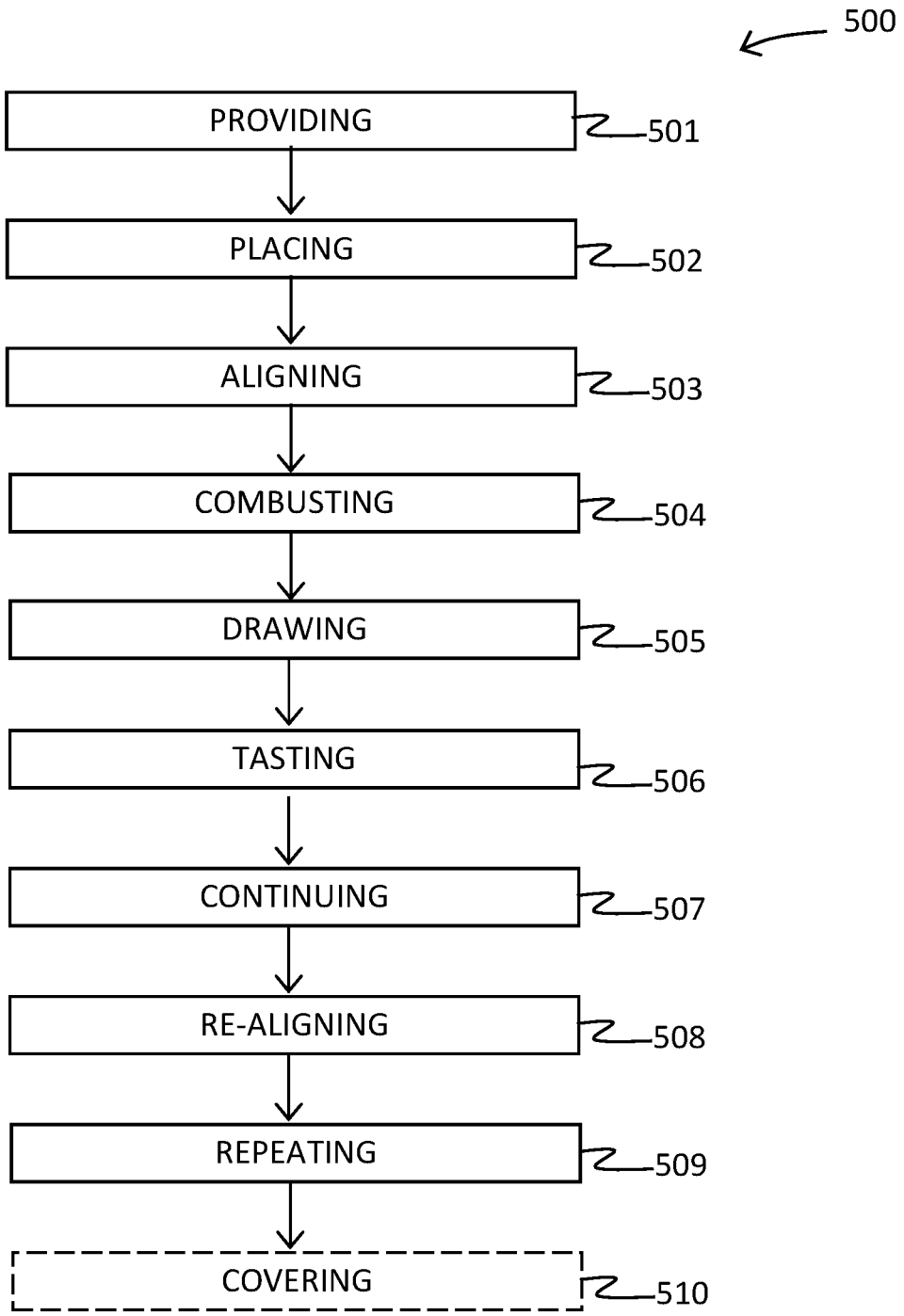
FIG. 5 is a flow diagram illustrating a method of use for smoking multiple reserves of combustible material with a smoking-pipe, according to an embodiment of the present disclosure.

FIG. 5 is a flow diagram illustrating a method of smoking multiple reserves of combustible material with a smoking-pipe 500, according to an embodiment of the present disclosure. In particular, the method for smoking multiple reserves of combustible material with a smoking-pipe 500 may include one or more components or features of the smoking-pipe 100 as described above. As illustrated, the method of smoking multiple reserves of combustible material with a smoking-pipe 500 may include the steps of: step one 501, providing a smoking-pipe comprising a smoking-pipe body as disclosed; step two 502, placing the combustible material in at least one of the plurality of smoking-chambers; step three 503, aligning a first of the smoking-chambers with the first-base aperture and the cover-aperture; step four 504, combusting the combustible material within the first of the smoking-chambers; step five 505, drawing a smoke produced by the combustible material though the internal shank-cavity into a mouth of a user; step six 506, tasting and alternatively inhaling the smoke; step seven 507, continuing to smoke until the combustible material within the first of the smoking-chambers is consumed; step eight 508, re-aligning an alternative one of the plurality of smoking chambers with the first-base aperture and the cover-aperture; step nine 509, repeating the process for successive smoking-chambers until the combustible material within all of the plurality of smoking-chambers is spent; and step ten 510, covering a carb-extension to regulate airflow into the smoking-pipe base.

It should be noted that step 510 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for smoking multiple reserves of combustible material with a smoking-pipe, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A smoking-pipe comprising:

a smoking-pipe body including a cylindrical base having a first-cylinder end, a second-cylinder end, a radial outer base-surface, a first-base aperture disposed within the first-cylinder end, a second-base aperture disposed within the radial outer base-surface, and an internal base-cavity connecting the first-base aperture and the second-base aperture, a shank having an attachment-end coupled to the second-base aperture of the cylindrical base, a mouthpiece distal to the attachment-end, and an internal shank-cavity comprising a passageway connecting the attachment-end to the mouthpiece, and a cylindrical axis-shaft affixed to and concentric to the first-cylinder end;

a cylinder configured to revolve about the cylindrical axis-shaft including a radial outer cylinder-surface, an axis shaft-aperture concentric to the cylinder dimensioned such that the axis-shaft aperture may accept and engage the cylindrical axis-shaft, and a plurality of smoking-chambers arranged radially about the axis shaft-aperture configured to align with the first-base aperture;

a cylinder-cover coupled to the smoking-pipe body having a cover-shank releasably coupled to the cylindrical axis-shaft, a shield permanently coupled to the cover-shank, such that the shield covers and retains the cylinder to the cylindrical base when the cover-shank is coupled to the cylindrical axis-shaft, the shield being dimension to cover the plurality of smoking-chambers, and a cover-aperture perforating the shield position concentrically to the first-base aperture when the cover-shank is coupled to the cylindrical axis-shaft;

a carb-aperture disposed on the radial outer base-surface, the carb-aperture being in fluid communication with the internal base-cavity; and a carb-extension comprising a spherical member coupled to the carb-aperture, the carb-extension having a first-extension aperture in abutment against the carb-aperture, a second-extension aperture, an internal cavity comprising a passageway connecting the first-extension aperture and the second-extension aperture in fluid communication with the carb-aperture, such that the carb-extension functions as an air inlet for the internal base-cavity.

2. The smoking-pipe of claim 1, wherein the second-base aperture of the cylindrical base includes internal threading.

3. The smoking-pipe of claim 1, wherein the attachment-end of the shank includes external threading dimensioned to removably couple with the second-base aperture of the cylindrical base.

4. The smoking-pipe of claim 1, wherein the plurality of smoking-chambers includes five adjacent smoking-chambers.

5. The smoking-pipe of claim 1, wherein the smoking-pipe body further includes a detent-aperture perforating disposed within the first-cylinder end, a detent-sphere retained within the detent-aperture, a detent-retainer circumscribing the detent-aperture, such that the detent-retainer engages and retains the detent-sphere within the detent-aperture, such that the detent-sphere is able to partially protrude from but not leave the detent-aperture, and a detent-spring disposed within the detent-aperture pressing the detent-sphere against the detent-retainer.

6. The smoking-pipe of claim 5, wherein the cylinder further includes a plurality of detent-recesses configured to engage the detent-sphere when the detent-spring presses the detent-sphere against the detent-retainer, the detent-spring being configured to simultaneously press the detent-sphere against the cylinder.

7. The smoking-pipe of claim 6, wherein the plurality of detent-recesses correspond to the plurality of smoking-chambers, such that a first of the plurality of detent-recesses engages the detent-sphere when a first of the plurality of smoking-chambers aligns with the first-base aperture, and such that a second of the plurality of detent-recesses engages the detent-sphere when a second of the plurality of smoking-chambers aligns with the first-base aperture, and so forth.

8. The smoking-pipe of claim 1, wherein the radial outer cylinder-surface is knurled, the radial outer cylinder-surface having a plurality of ridges configured to improve grip by a user engaging the radial outer cylinder-surface.

9. The smoking-pipe of claim 1, wherein the carb-aperture includes internal threading.

10. The smoking-pipe of claim 1, wherein the carb-extension further includes external threading dimensioned to removably couple with the carb-aperture.

11. The smoking-pipe of claim 1, wherein the smoking-pipe body, the cylinder, and the cylinder-cover are constructed of steel.

12. The smoking-pipe of claim 1, wherein the smoking-pipe body, the cylinder, and the cylinder-cover are constructed of aluminum.

13. The smoking-pipe of claim 1, wherein the smoking-pipe body, the cylinder, and the cylinder-cover are constructed of brass.

14. The smoking-pipe of claim 1, wherein the cylindrical base, the cylinder, and the cylinder-cover are each lathe-turned during manufacture.

15. A smoking-pipe having multiple selectable chambers, the smoking-pipe comprising:

a smoking-pipe body including a cylindrical base having a first-cylinder end, a second-cylinder end, a radial outer base-surface, a first-base aperture disposed within the first-cylinder end, a second-base aperture disposed within the radial outer base-surface, and an internal base-cavity connecting the first-base aperture and the second-base aperture, a shank having an attachment-end coupled to the second-base aperture of the cylindrical base, a mouthpiece distal to the attachment-end, and an internal shank-cavity comprising a passageway connecting the attachment-end to the mouthpiece, and a cylindrical axis-shaft affixed to and concentric to the first-cylinder end;

a cylinder configured to revolve about the cylindrical axis-shaft including a radial outer cylinder-surface, an axis shaft-aperture concentric to the cylinder dimensioned such that the axis-shaft aperture may accept and engage the cylindrical axis-shaft, and a plurality of smoking-chambers arranged radially about the axis shaft-aperture configured to align with the first-base aperture; and a cylinder-cover coupled to the smoking-pipe body having a cover-shank releasably coupled to the cylindrical axis-shaft, a shield permanently coupled to the cover-shank, such that the shield covers and retains the cylinder to the cylindrical base when the cover-shank is coupled to the cylindrical axis-shaft, the shield being dimension to cover the plurality of smoking-chambers, and a cover-aperture perforating the shield position concentrically to the first-base aperture when the cover-shank is coupled to the cylindrical axis-shaft;

wherein the second-base aperture of the cylindrical base includes internal threading;

wherein the attachment-end of the shank includes external threading dimensioned to removably couple with the second-base aperture of the cylindrical base;

wherein the plurality of smoking-chambers includes five adjacent smoking-chambers;

wherein the smoking-pipe body further includes a detent-aperture perforating disposed within the first-cylinder end, a detent-sphere retained within the detent-aperture, a detent-retainer circumscribing the detent-aperture, such that the detent-retainer engages and retains the detent-sphere within the detent-aperture, such that the detent-sphere is able to partially protrude from but not leave the detent-aperture, and a detent-spring disposed within the detent-aperture pressing the detent-sphere against the detent-retainer;

wherein the cylinder further includes a plurality of detent-recesses configured to engage the detent-sphere when the detent-spring presses the detent-sphere against the detent-retainer, the detent-spring being configured to simultaneously press the detent-sphere against the cylinder;

wherein the plurality of detent-recesses correspond to the plurality of smoking-chambers, such that a first of the plurality of detent-recesses engages the detent-sphere when a first of the plurality of smoking-chambers aligns with the first-base aperture, and such that a second of the plurality of detent-recesses engages the detent-sphere when a second of the plurality of smoking-chambers aligns with the first-base aperture, and so forth;

wherein the radial outer cylinder-surface is knurled, the radial outer cylinder-surface having a plurality of ridges configured to improve grip by a user engaging the radial outer cylinder-surface;

wherein the smoking-pipe body further includes a carb-aperture disposed on the radial outer base-surface, the carb-aperture being in fluid communication with the internal base-cavity;

wherein the smoking-pipe further includes a carb-extension comprising a spherical member coupled to the carb-aperture, the carb-extension having a first-extension aperture in abutment against the carb-aperture, a second-extension aperture, an internal cavity comprising a passageway connecting the first-extension aperture and the second-extension aperture in fluid communication with the carb-aperture, such that the carb-extension functions as an air inlet for the internal base-cavity;

wherein the carb-aperture includes internal threading; and wherein the carb-extension further includes external threading dimensioned to removably couple with the carb-aperture.

16. The smoking-pipe of claim 15, further comprising set of instructions; and wherein the smoking-pipe is arranged as a kit.

* * * * *